US011850461B2

(12) United States Patent
Carr et al.

(10) Patent No.: US 11,850,461 B2
(45) Date of Patent: Dec. 26, 2023

(54) GOLF CLUB HEAD HAVING SUPPORTED STRIKING FACE

(71) Applicant: Acushnet Company, Fairhaven, MA (US)

(72) Inventors: Kyle A Carr, Carlsbad, CA (US); Joshua G. Breier, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 83 days.

(21) Appl. No.: 17/692,576

(22) Filed: Mar. 11, 2022

(65) Prior Publication Data

US 2023/0285814 A1 Sep. 14, 2023

(51) Int. Cl.
*A63B 53/04* (2015.01)

(52) U.S. Cl.
CPC ..... *A63B 53/047* (2013.01); *A63B 53/0408* (2020.08); *A63B 2209/00* (2013.01)

(58) Field of Classification Search
CPC ..... A63B 53/047; A63B 53/0408; A63B 2209/00
See application file for complete search history.

(56) References Cited

U.S. PATENT DOCUMENTS 700,946 A * 5/1902 Kempshall ..... A63B 53/0466 473/329
819,900 A 5/1906 Martin
4,229,550 A 10/1980 Jones
4,448,941 A 5/1984 Cheung et al.
4,681,322 A 7/1987 Straza et al.
5,058,895 A 10/1991 Igarashi
5,106,094 A 4/1992 Desbiolles et al.
5,132,178 A 7/1992 Chyung et al.
5,163,682 A 11/1992 Schmidt et al.
5,238,529 A 8/1993 Douglas
5,303,922 A 4/1994 Lo
5,310,185 A 5/1994 Viollaz et al.
5,316,298 A 5/1994 Hutin et al.
5,328,176 A 7/1994 Lo
5,346,216 A 9/1994 Aizawa
5,358,249 A 10/1994 Mendralla
5,362,055 A 11/1994 Rennie
5,403,007 A 4/1995 Chen
5,405,136 A 4/1995 Hardman
5,405,137 A 4/1995 Vincent
5,425,538 A 6/1995 Vincent et al.
5,431,396 A 7/1995 Shieh
(Continued)

FOREIGN PATENT DOCUMENTS

JP H05-7261 2/1993

OTHER PUBLICATIONS

The Royal and Ancient Golf Club of St. Andrews and USGA, Technical Description of the Pendulum Test, Revised Version, Nov. 2003.

(Continued)

*Primary Examiner* — William M Pierce

(57) ABSTRACT

A golf club head having a supported striking face is disclosed herein. More specifically, the golf club head in accordance with the present invention has a striking face, an internal support layer, and an intermediary sandwiched layer juxtaposed between the striking face and the internal support layer.

21 Claims, 7 Drawing Sheets

(56) References Cited

U.S. PATENT DOCUMENTS 5,433,440 A 7/1995 Lin
5,447,311 A * 9/1995 Viollaz ..... A63B 53/04 473/347
5,489,094 A 2/1996 Pritchett
5,524,331 A 6/1996 Pond
5,720,673 A 2/1998 Anderson
5,743,813 A 4/1998 Chen et al.
5,766,092 A * 6/1998 Mimeur ..... A63B 60/00 473/332
5,766,093 A 6/1998 Rohrer
5,766,094 A 6/1998 Mahaffey et al.
5,772,527 A * 6/1998 Liu ..... A63B 60/00 473/409
5,827,131 A 10/1998 Mahaffey et al.
5,863,261 A * 1/1999 Eggiman ..... A63B 60/00 473/345
5,967,903 A * 10/1999 Cheng ..... A63B 53/047 473/349
6,074,309 A 6/2000 Mahaffey
6,165,081 A 12/2000 Chou
6,238,300 B1 5/2001 Igarashi
6,238,302 B1 5/2001 Helmstetter et al.
6,248,025 B1 6/2001 Murphy
6,302,807 B1 10/2001 Rohrer
6,354,962 B1 3/2002 Galloway
6,364,789 B1 4/2002 Kosmatka
6,390,932 B1 5/2002 Kosmatka
6,406,382 B1 6/2002 Deshmukh et al.
6,428,427 B1 8/2002 Kosmatka
6,440,008 B2 8/2002 Murphy et al.
6,443,857 B1 9/2002 Chuang
6,533,681 B2 3/2003 Inoue et al.
6,527,650 B2 4/2003 Reyes et al.
6,605,007 B1 8/2003 Bissonnette et al.
6,612,938 B2 9/2003 Murphy et al.
6,617,013 B2 9/2003 Morrison et al.
6,623,543 B1 9/2003 Zeller et al.
6,638,179 B2 10/2003 Yoshida
6,638,180 B2 10/2003 Tsurumaki
6,648,774 B1 11/2003 Lee
6,672,975 B1 1/2004 Galloway
6,743,117 B2 * 6/2004 Gilbert ..... A63B 53/047 473/332
6,780,124 B2 8/2004 Lu
6,837,094 B2 1/2005 Pringle et al.
6,945,876 B2 9/2005 Nakahara et al.
6,949,032 B2 9/2005 Kosmatka
6,971,960 B2 12/2005 Dewanjee et al.
6,986,715 B2 1/2006 Mahaffey
7,029,403 B2 4/2006 Rice et al.
7,086,963 B1 8/2006 Onuki et al.
7,101,290 B2 9/2006 Tucker, Sr.
7,108,612 B2 9/2006 Nakahara et al.
7,121,958 B2 10/2006 Cheng et al.
7,140,974 B2 11/2006 Chao et al.
7,160,204 B2 1/2007 Huang
7,175,540 B2 2/2007 Sano
7,182,698 B2 * 2/2007 Tseng ..... A63B 53/0475 473/332
7,192,365 B2 3/2007 Souza
7,214,143 B2 5/2007 Deshmukh
7,214,144 B2 5/2007 Tseng
7,267,620 B2 9/2007 Chao et al.
7,273,420 B2 9/2007 Wright
7,281,990 B2 * 10/2007 Hagood ..... A63B 53/04 473/332
7,281,991 B2 10/2007 Gilbert et al.
7,281,994 B2 10/2007 De Shiell et al.
7,331,877 B2 2/2008 Yamaguchi et al.
7,384,348 B2 6/2008 Lin
7,399,238 B2 7/2008 Hocknell et al.
7,410,428 B1 8/2008 Dawson
7,591,736 B2 9/2009 Ban
7,601,078 B2 10/2009 Mergy et al.
7,628,712 B2 12/2009 Chao et al.
7,651,408 B2 * 1/2010 Hagood ..... A63B 60/00 473/332
7,775,903 B2 8/2010 Kawaguchi
7,811,179 B2 10/2010 Roach et al.
7,850,545 B2 12/2010 Wada et al.
7,850,546 B2 12/2010 Chao et al.
7,862,452 B2 1/2011 Chao et al.
7,867,612 B2 1/2011 Schwung et al.
7,871,340 B2 1/2011 Chao
7,874,938 B2 1/2011 Chao
7,927,229 B2 4/2011 Jertson et al.
7,985,146 B2 7/2011 Lin et al.
8,152,652 B2 4/2012 Curtis et al.
8,163,119 B2 4/2012 Chao
8,221,261 B2 7/2012 Curtis et al.
8,247,062 B2 8/2012 Morrison et al.
8,293,356 B2 10/2012 Merrill et al.
8,303,432 B2 11/2012 Curtis et al.
8,376,873 B2 2/2013 Golden et al.
8,376,879 B2 2/2013 Wada et al.
8,409,032 B2 4/2013 Myrhum et al.
8,430,986 B1 4/2013 Galloway
8,444,504 B2 5/2013 Chao et al.
8,449,406 B1 5/2013 Frame
8,496,542 B2 7/2013 Curtis et al.
8,517,859 B2 8/2013 Golden et al.
8,758,161 B2 6/2014 Golden et al.
8,777,776 B2 7/2014 Wahl et al.
8,876,629 B2 11/2014 Deshmukh et al.
9,022,880 B2 * 5/2015 Kawaguchi ..... A63B 53/04 473/331
9,033,818 B2 5/2015 Myrhum
9,033,822 B1 5/2015 DeMille
9,192,826 B2 11/2015 Golden et al.
9,283,447 B1 3/2016 DeMille
9,283,448 B2 * 3/2016 Sander ..... A63B 53/0466
9,539,478 B2 * 1/2017 Narita ..... A63B 53/047
9,717,960 B2 8/2017 Deshmukh
9,795,844 B1 * 10/2017 Dacey ..... A63B 53/0487
9,844,230 B2 12/2017 Bhattacharyya
10,357,901 B2 7/2019 Deshmukh
10,391,370 B2 8/2019 Tassistro
10,960,272 B2 * 3/2021 Kawaguchi ..... A63B 53/047
11,192,003 B2 * 12/2021 Parsons ..... A63B 53/04
11,491,377 B1 * 11/2022 Sanchez ..... A63B 53/0416
11,679,313 B2 * 6/2023 Luttrell ..... A63B 53/0433 473/324
2001/0051549 A1 12/2001 Inoue et al.
2002/0019265 A1 2/2002 Allen
2002/0113338 A1 8/2002 Murphy
2002/0165040 A1 11/2002 Kosmatka et al.
2002/0187852 A1 12/2002 Kosmatka et al.
2003/0157995 A1 8/2003 Mahaffey
2003/0183328 A1 10/2003 Lee
2004/0266550 A1 12/2004 Gilbert et al.
2005/0003903 A1 1/2005 Galloway
2005/0020378 A1 1/2005 Krumme
2005/0043117 A1 2/2005 Gilbert
2005/0064956 A1 3/2005 Lee
2005/0101406 A1 5/2005 Hirano
2005/0124437 A1 6/2005 Imamoto
2005/0209024 A1 9/2005 Oyama
2005/0215352 A1 9/2005 Oyama
2005/0239576 A1 10/2005 Stites
2006/0052185 A1 3/2006 Kawaguchi
2006/0220279 A1 10/2006 Reyes
2006/0229141 A1 10/2006 Galloway
2007/0060414 A1 3/2007 Breier
2007/0099722 A1 5/2007 Stevens
2008/0004131 A1 1/2008 Lin et al.
2008/0051219 A1 2/2008 Erickson
2008/0076595 A1 3/2008 Lai et al.
2008/0096687 A1 4/2008 Chen
2008/0149267 A1 6/2008 Chao
2008/0268980 A1 10/2008 Breier
2008/0289747 A1 11/2008 Modin
2008/0293511 A1 11/2008 Gilbert et al.
2008/0300068 A1 12/2008 Chao

(56) References Cited

U.S. PATENT DOCUMENTS

| | | | | |
|---|---|---|---|---|
| 2009/0163293 | A1 | 6/2009 | Gibb | |
| 2010/0125000 | A1* | 5/2010 | Lee | A63B 60/00 473/282 |
| 2011/0065528 | A1 | 3/2011 | Dawson | |
| 2011/0256954 | A1 | 10/2011 | Soracco | |
| 2012/0135822 | A1 | 5/2012 | Deshmukh et al. | |
| 2012/0172143 | A1 | 7/2012 | Greaney | |
| 2012/0289363 | A1 | 11/2012 | Myrhum et al. | |
| 2013/0040754 | A1 | 2/2013 | Morin | |
| 2013/0040756 | A1 | 2/2013 | Myrhum | |
| 2013/0040757 | A1 | 2/2013 | Deshmukh | |
| 2013/0252757 | A1 | 9/2013 | Deshmukh et al. | |
| 2013/0324301 | A1 | 12/2013 | Boyd | |
| 2014/0038749 | A1 | 2/2014 | Beach | |
| 2014/0256467 | A1 | 9/2014 | Lorentzen | |
| 2014/0274454 | A1* | 9/2014 | Snyder | A63B 53/047 473/332 |
| 2014/0274456 | A1 | 9/2014 | Cardani | |
| 2014/0323237 | A1 | 10/2014 | Beno | |
| 2015/0045146 | A1 | 2/2015 | Deshmukh et al. | |
| 2015/0108681 | A1 | 4/2015 | Deshmukh | |
| 2015/0111664 | A1 | 4/2015 | Myrhum | |
| 2016/0144246 | A1 | 5/2016 | Onuki | |
| 2018/0008870 | A1 | 1/2018 | Cornelius | |
| 2019/0126108 | A1 | 5/2019 | Parsons et al. | |
| 2019/0224533 | A1 | 7/2019 | Spackman | |
| 2020/0023244 | A1 | 1/2020 | Parsons | |
| 2020/0061422 | A1* | 2/2020 | Chuang | A63B 53/0429 |
| 2020/0086386 | A1* | 3/2020 | Koehler | B22F 10/38 |
| 2020/0230471 | A1 | 7/2020 | Parsons | |
| 2021/0016137 | A1* | 1/2021 | Cleghorn | A63B 53/0416 |

OTHER PUBLICATIONS

Machine Translation of JPH05-7261.

* cited by examiner

GOLF CLUB HEAD HAVING SUPPORTED STRIKING FACE

FIELD OF THE INVENTION

The present invention relates generally to a golf club head having a polymer supported striking face. More specifically, the golf club head in accordance with the present invention is further comprised of a striking face portion, an internal support layer, and an intermediary sandwiched layer juxtaposed between the striking face portion and the internal support layer.

BACKGROUND OF THE INVENTION

Modern day golf club design has evolved since the early days of golf. The good news of all the technological advancements in golf club technology is that it makes the game of golf easier for golfers of all skill levels. However, all these advancements come with tremendous challenges for the golf club engineer.

One of the latest trends in golf club design is the utilization of multiple different materials in the same golf club head to take advantage of the individual performance characteristics the base material, and combining them to create a better performing golf club head. U.S. Pat. No. 5,316,298 to Hutin et al. discloses a club head with a front strike face with a vibration damper on the rear surface. The vibration damper includes a constraining layer connected to the rear surface through an interposed visco-elastic material.

U.S. Pat. No. 9,844,230 to Snyder shows an iron body and a ball striking plate engaged with the iron body. The ball striking plate may include a face layer and a backing layer of a polymeric material to isolate the face layer from the iron body.

It should be noted that although the utilization of multi-material golf club head has been around, the industry has always been perplexed by the utilization of multi-material around the striking face portion of the golf clubhead due to the high amount of stress when impacting a golf ball. The present invention focuses on a golf club head having a multi-layered, multi-material striking face of a golf club head to further improve the performance of a golf club head.

BRIEF SUMMARY OF THE INVENTION

One aspect of the present invention is an iron type golf club comprising a golf club head, a grip and a shaft therebetween, wherein the golf club head comprises has improved COR and feel. The golf club head is preferably comprised of a striking face portion located at a frontal portion and an aft body portion attached to the striking face portion to form a cavity therebetween. The golf club head has a topline, a sole, a toe portion, a heel portion and a hosel. In the invention, the striking face portion preferably has a thickness of between 0.6 mm and 2.4 mm at the face center. The iron type golf club head is further comprised of an internal support layer located in the cavity that is coupled to the aft body portion and an intermediary sandwiched layer juxtaposed between the striking face portion and the internal support layer. The intermediary sandwiched layer is preferably comprised of a polymeric material having a sandwiched face layer hardness less than 75 Shore A and has a thickness of 1 mm and 10 mm at the face center. In an embodiment of the invention, the internal support layer only abuts between 25% and 75% of the intermediary sandwiched layer. Moreover, it is preferred that the intermediary sandwiched layer abuts significantly more of the striking face portion and preferably between 90% and 100% of the striking face portion. Most preferably, the internal support layer comprises a perimeter support portion circumscribing the cavity in the golf club head and has a width of between 2 mm and 20 mm and a thickness of between 0.5 mm and 5 mm. Thus, the intermediary sandwiched layer is supported by the perimeter portion, but a substantial portion is not supported by the internal support layer. In one embodiment, the perimeter support portion has a topline width $W_{TL}$ adjacent the topline that is between 2 mm and 5 mm and a sole width $W_S$ adjacent the sole that is between 6 mm and 20 mm. Preferably, the sole width $W_S$ is at least 1.5 times greater than the topline width $W_{TL}$.

Another preferred embodiment of the present invention is an iron type golf club comprising a golf club head, a grip and a shaft therebetween, wherein the golf club head comprises has improved COR and feel. The golf club head is preferably comprised of a striking face portion located at a frontal portion and an aft body portion attached to the striking face portion to form a cavity therebetween. The golf club head has a topline, a sole, a toe portion, a heel portion and a hosel. In the invention, the striking face portion preferably has a thickness of between 0.6 mm and 2.4 mm at the face center. The iron type golf club head is further comprised of an internal support layer located in the cavity that is coupled to the aft body portion and an intermediary sandwiched layer juxtaposed between the striking face portion and the internal support layer. The intermediary sandwiched layer is preferably comprised of a polymeric material having a sandwiched face layer hardness less than 75 Shore A and has a thickness of 1 mm and 10 mm at the face center. The internal support layer only abuts between 25% and 75% of the intermediary sandwiched layer and is comprised of a perimeter support portion circumscribing the cavity in the golf club head and a horizontal support section extending from a heel section of the perimeter support portion to a toe section of the perimeter support portion. Preferably, the horizontal support section has a horizontal support width $W_H$ between 5 mm and 10 mm. Moreover, the horizontal support section can have a center portion that is closer to the striking face portion such that the intermediary sandwiched layer has a face center thickness that is between 80% and 40% of an intermediary sandwiched layer thickness closer to the topline, sole, toe portion or heel portion.

In an alternative embodiment of the present invention, the internal support layer only abuts between 25% and 75% of the intermediary sandwiched layer and is comprised of a perimeter support portion circumscribing the cavity in the golf club head and a vertical support section extending from a topline section of the perimeter support portion to a sole section of the perimeter support portion. Preferably, the vertical support section has a vertical support width $W_V$ between 8 mm and 15 mm. Moreover, the vertical support section can have a center portion that is closer to the striking face portion such that the intermediary sandwiched layer has a face center thickness that is between 80% and 40% of an intermediary sandwiched layer thickness closer to the topline, sole, toe portion or heel portion.

In a preferred embodiment, the internal support layer is comprised of steel and is integrally cast with the aft body portion. In another preferred embodiment the internal support layer is comprised of a thermoplastic material having a support tensile strength that is at least 10 times greater than a tensile strength of the intermediary sandwiched layer.

In a preferred embodiment of the present invention, the striking face portion of the golf club head is very thin and, more particularly, has a thickness of between 1.4 mm and 1.8 mm at the face center. Furthermore, it is preferred that the intermediary sandwiched layer has a thickness of 4 mm and 7 mm at the face center. Thus, the intermediary sandwiched layer has a thickness that is greater than twice as thick as the striking face portion thickness.

Yet another aspect of the present invention is an iron type golf club comprising a golf club head, a grip and a shaft therebetween, wherein the golf club head comprises has improved COR and feel. The iron type golf club comprises a golf club head, a grip and a shaft therebetween. Preferably, the head comprises a striking face portion located at a frontal portion of the golf club head and an aft body portion attached to the striking face portion forming a cavity therebetween, a topline, a sole, a toe portion, a heel portion and a hosel. Preferably, the striking face portion has a face center and a thickness of between 0.8 mm and 2.4 mm at the face center. Moreover, an internal support layer is coupled to the aft body portion such that it is located in the cavity and has a forward-facing front surface and an intermediary sandwiched layer is juxtaposed between the striking face portion and the internal support layer. Preferably, the intermediary sandwiched layer has a thickness of 1 mm and 10 mm at the face center and is comprised of a polymeric material having a sandwiched face layer tensile strength of between 4 MPa and 20 MPa. Preferably, the internal support layer comprises a thermoplastic material having a support layer tensile strength of between 60 MPa and 300 MPa and comprises a perimeter support portion circumscribing the cavity. Preferably, the perimeter support portion has a perimeter width of between 2 mm and 20 mm and a thickness of between 0.5 mm and 5 mm. Most preferably, the striking face portion has a back surface, and the intermediary sandwiched layer front surface abuts between 90% and 100% of the striking face portion back surface while the internal support layer only abuts between 25% and 75% of the intermediary sandwiched layer. In one embodiment, the internal support layer further comprises a horizontal support section extending from a heel section of the perimeter support portion to a toe section of the perimeter support portion. Preferably, the horizontal support section has a horizontal support width that is at least 10% greater than the perimeter width. In an alternate embodiment, the internal support layer further comprises a vertical support section extending from a topline section of the perimeter support portion to a sole section of the perimeter support portion.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

Figure 1:
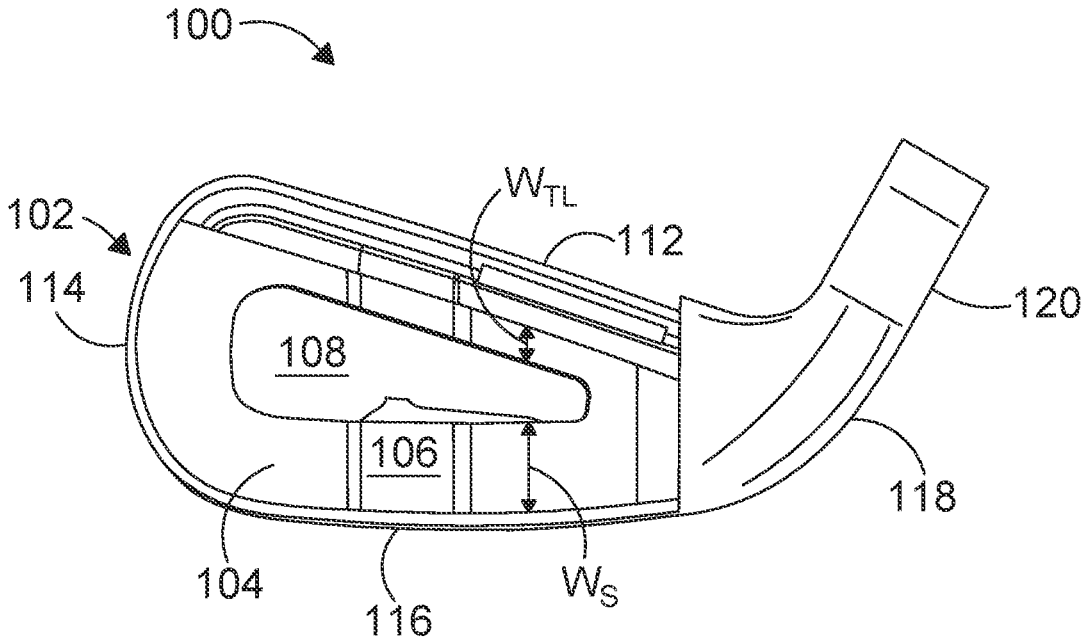
FIG. 1 of the accompanying drawings shows a frontal view of a golf club head body portion in accordance with an embodiment of the present invention.

The following detailed description describes the best currently contemplated modes of carrying out the invention. The description is not to be taken as limiting the invention and is provided for the sole purpose of illustrating the general principles of the invention. The scope of the invention is best defined by the appended claims. Various inventive features are described below, and each can be used independently of one another or in combination with other features.

FIGS. 1-4 of the accompanying drawings shows a golf club head 100 in accordance with an exemplary embodiment of the present invention. Golf club head 100 shown here an aft body portion or body portion 102, including a topline portion 112, a toe portion 114, a sole portion 116, a heel portion 118 and a hosel 120. The body portion 102 is further comprised of an internal face support 104 that includes a perimeter support portion 106 and a center portion 108. The perimeter support portion 106 is solid steel and preferably cast with the body portion 102 such that it is rigid with the body portion 102. The perimeter support portion further surrounds the hollow center portion 108.

Figure 2:
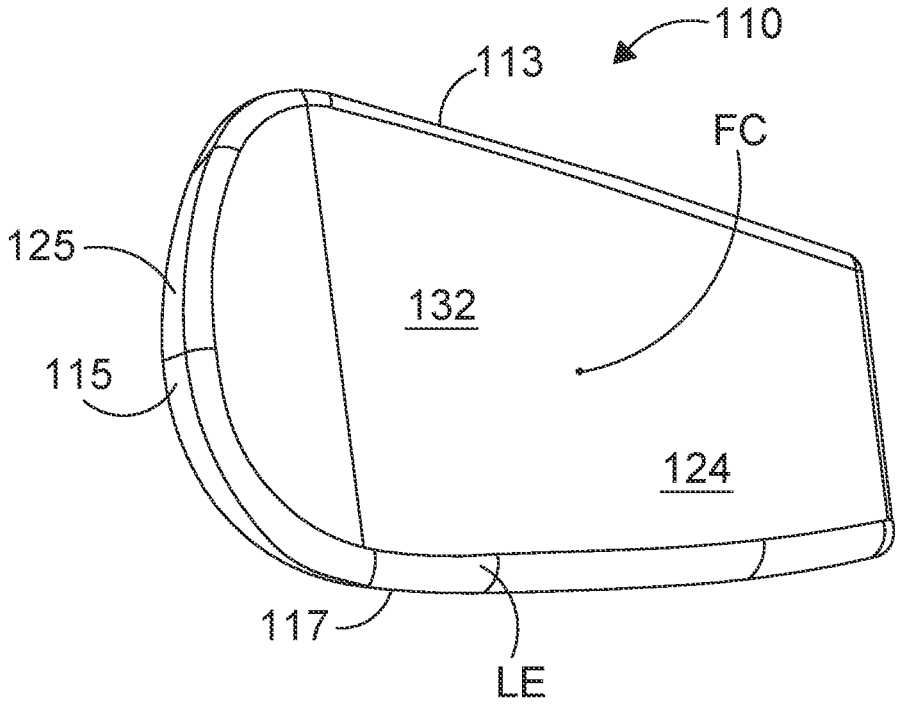
FIG. 2 of the accompanying drawings shows a frontal view of a golf club head face cup that couples to the body portion disclosed in FIG. 1.

The striking face portion 110 shown in FIG. 2 includes a frontal face portion 124 a return portion 125, and a face center FC. Furthermore, FIG. 2 illustrates the striking face portion 110 can be formed as a face cup such that it forms the leading-edge LE and has a toe portion 115, topline portion 113 and a sole portion 117 that couple to the body portion's toe portion 114, topline portion 112 and sole portion 116, respectively. When the striking face portion 110 is coupled to the body portion 102, preferably by welding around the striking face portion 110, the striking face portion 110 and the body portion 102 form a cavity between the frontal face portion 124 and the internal face support 104.

Figure 3:
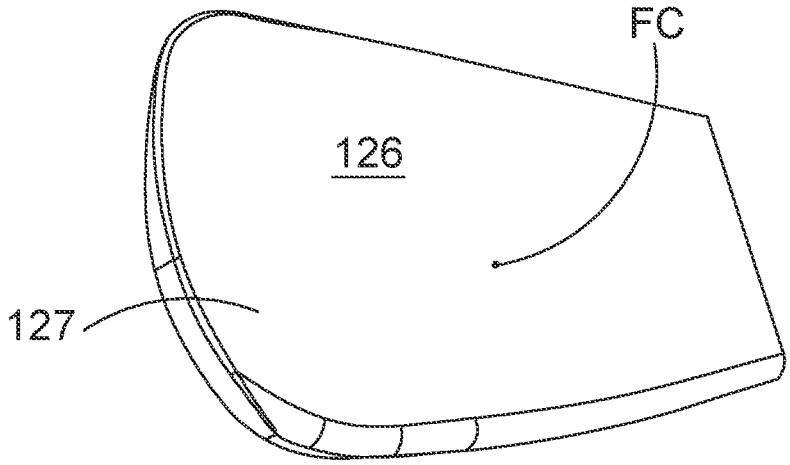
FIG. 3 of the accompanying drawings shows a golf club head intermediary layer that is juxtaposed the body portion of FIG. 1 and the face cup of FIG. 2.
Figure 4:
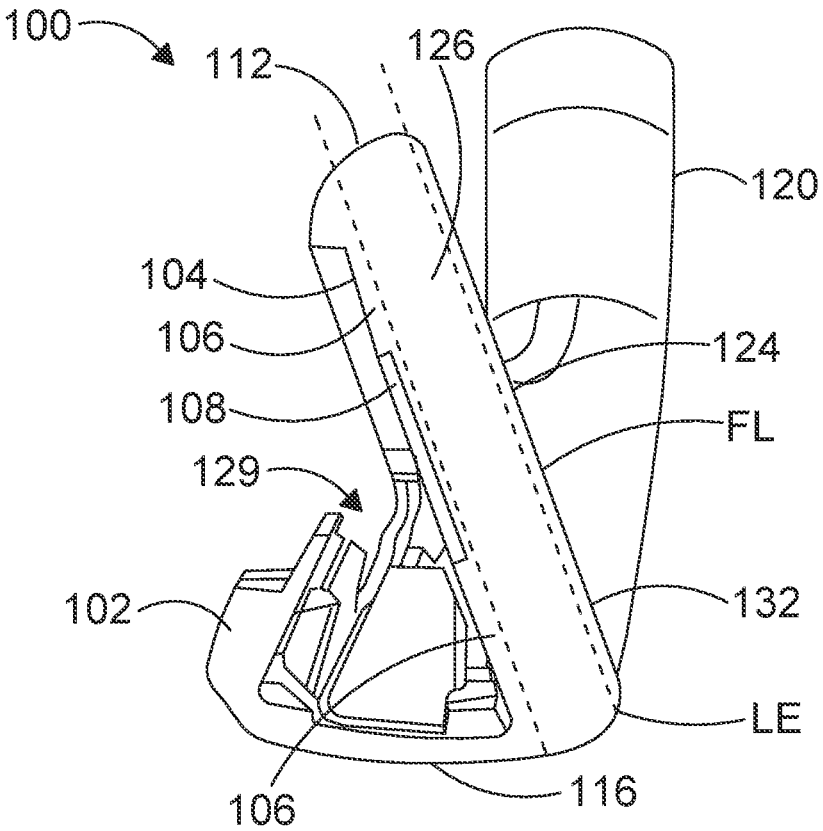
FIG. 4 of the accompanying drawings shows a cross-sectional view of the golf club head in accordance with FIGS. 1-3.

FIG. 3 shows an intermediary sandwiched layer 126 that is sandwiched in the cavity between a back surface of the frontal face portion 124 and the internal face support 104. The intermediary sandwiched layer 126 has a frontal facing surface 127 that is substantially the same area as the back surface of the frontal face portion 124. Preferably, intermediary sandwiched layer 126 is supported by the internal face support 104 around its perimeter, i.e., the intermediary sandwiched layer 126 is supported by the internal face support perimeter support portion 106 near the topline portion 112, the toe portion 114, the sole portion 116, and the heel portion 118. However, the internal face support 104 has a hollow center portion 108 that doesn't support the intermediary sandwiched layer 126 like the perimeter support portion 106 does. Preferably, the center portion 108 circumscribes the face center FC projection to allow the face center FC of the external frontal face portion 124 to deflect at impact to improve the overall striking face COR.

The external frontal face portion 124 is preferably formed of steel and located at an external frontal portion of the striking face portion 110. The external frontal face portion 124 has a substantially planar striking outer surface 132 that includes a plurality of grooves, not shown. More preferably, the external frontal face portion 124 is formed of a high strength steel having an Ultimate Tensile Strength of greater than 2000 MPa and more preferably greater than 2300 MPa. Most preferably, the external frontal face portion 124 is formed from AerMet 340 or the like. Moreover, it is preferred that the external frontal face portion 124 has a uniform thickness of about 0.6 mm to about 2.4 mm. Most preferably, the external frontal face portion 124 has a uniform thickness of about 1.4 mm to about 1.8 mm. This thin external frontal face portion 124 and its high strength assist in creating the high COR of the golf club head 100.

The internal face support 104 is formed in an internal hollow portion 129 of the golf club head 100. The internal face support 104 is preferably formed from steel having a tensile strength of about 400 MPa or greater and can be cast as a portion of the golf club head body portion 102 or formed of sheet metal, stamped or forged to shape and welded to the golf club head body 102. Preferably, the internal face support 104 has a thickness that is between about 0.5 mm and 5 mm, and more preferably, between about 0.8 mm and 2 mm.

The striking face portion 110 is abutted by the intermediary sandwiched layer 126, which is juxtaposed between the frontal face portion 124 and the internal face support 104. Preferably, intermediary sandwiched layer 126 is supported by the internal face support 104 around its perimeter, i.e., the intermediary sandwiched layer 126 is supported along the topline portion, the toe portion, the sole portion and the heel portion. This helps improve the overall striking face COR.

The intermediary sandwiched layer 126 is a polymeric material having a tensile strength within the range of about 4 MPa and 20 MPa and more preferably, 6 MPa and 12 MPa, when measured according to ASTM D412. The intermediary sandwiched layer 126 can be pre-formed and inserted into the cavity or can be injection molded into the cavity between the back surface of the frontal face portion 124 and the internal face support 104. The very low tensile strength allows the external frontal face portion to deflect during impact and assists in creating a striking face portion with a very high COR. Still further, to keep the striking face portion from being too heavy, the specific gravity of the polymer is preferably between about 0.95 and 1.2 and the polymer has a Shore A hardness of less than 75, and preferably between about 30 and 60. Preferably, the intermediary sandwiched layer 126 is comprised of a silicone material, and more preferably, a silicone rubber such as SH9151U sold by KCC Silicone Corporation. Furthermore, the intermediary sandwiched layer 126 preferably has a substantially uniform thickness of about 1 mm to 10 mm, and more preferably, between about 3 mm and 7 mm. The intermediary sandwiched layer 126 is also preferably at least twice as thick as the external frontal face portion thickness at the face center FC.

As stated above, the intermediary sandwiched layer 126 is supported by the internal face support perimeter support portion 106 near the topline portion 112, the toe portion 114, the sole portion 116, and the heel portion 118. The perimeter support portion 106 preferably has a width of between about 2 mm and 20 mm. More preferably, the perimeter support portion 106 has a first topline width $W_{TL}$ adjacent the topline portion 112 that is between about 2 mm and 5 mm and a second sole width $W_S$ that is adjacent the sole portion 116 that is between about 6 mm and 20 mm and is at least 1.5 times greater than the first width Wm. Moreover, the internal face support 104 has a hollow center portion 108 that doesn't support the intermediary sandwiched layer 126 and abuts between 25% and 75% of the intermediary sandwiched layer back surface while the intermediary sandwiched layer 126 covers between 90% and 100% of the back surface of the frontal face portion 124. Thus, the frontal face portion 124 is substantially dampened by the intermediary sandwiched layer 126, but 75% to 25% of the intermediary sandwiched layer 126 is unconstrained by the internal face support 104. Preferably, the center portion 108 circumscribes the face center FC projection to allow the face center FC of the external frontal face portion 124 to deflect at impact to improve the overall striking face COR.

Figure 5:
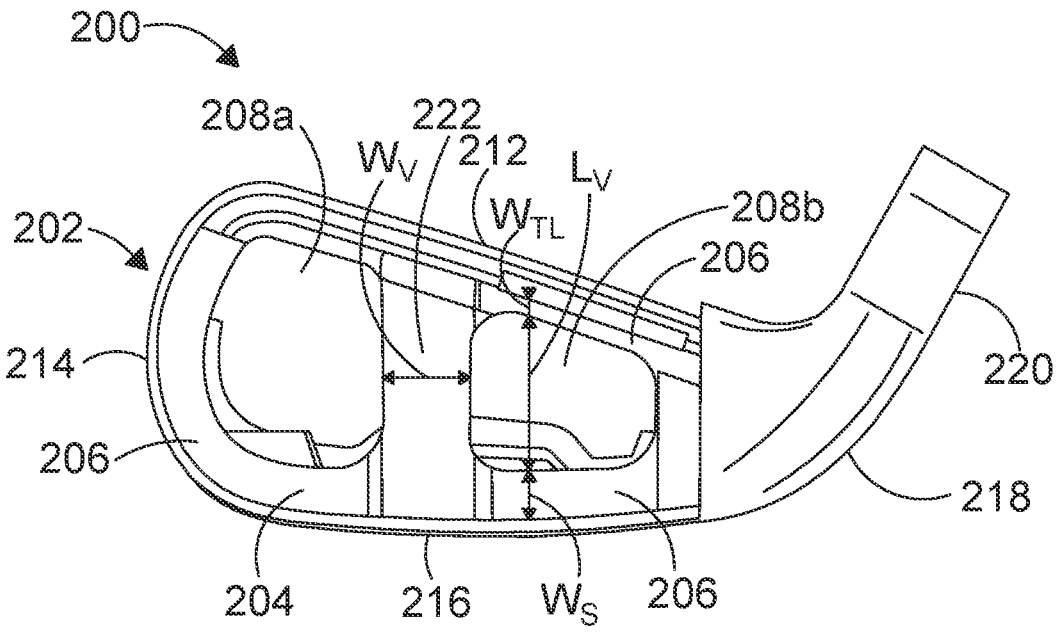
FIG. 5 of the accompanying drawings shows a frontal view of an alternate embodiment of the golf club head body in FIG. 1.

FIG. 5 discloses an alternate embodiment of the body disclosed in FIG. 1 and can be used with the striking face portion 110 and intermediary sandwiched layer 126 as discussed above and with reference to FIGS. 2 and 3, respectively. Golf club head 200 shown here has an aft body portion or body portion 202, including a topline portion 212, a toe portion 214, a sole portion 216, a heel portion 218 and hosel 220. The body portion 202 is further comprised of an internal face support 204 that includes a perimeter support portion 206 and a center portion 208. The perimeter support portion 206 is solid steel and preferably cast with the body portion 202 such that it is rigid with the body portion 202. The perimeter support portion 206 further surrounds the hollow center portion 208. This embodiment is further comprised of a vertical support portion 222 that divides the hollow center portion 208 into a hollow toe side portion **208*a* and a hollow heel side portion 208*b*. In this embodiment, the vertical support portion 222 is solid steel and is also preferably cast with the body portion 202**.

As discussed above, the intermediary sandwiched layer 126 is supported by the internal face support 204 perimeter support portion 206 near the topline portion 212, the toe portion 214, the sole portion 216, and the heel portion 218. The intermediary sandwiched layer 126 is also supported by the vertical support portion 222 of the internal face support 204 behind the face center FC. The perimeter support portion 206 preferably has a width of between about 2 mm and 20 mm. More preferably, the perimeter support portion has a first topline width $W_{TL}$ adjacent the topline portion 212 that is between about 2 mm and 5 mm and a second sole width $W_S$ that is adjacent the sole portion 216 that is between about 6 mm and 20 mm and is at least 1.5 times greater than the first topline width $W_{TL}$. Moreover, the internal face support 204 has hollow center portions 208*a* and 208*b* that don't support the intermediary sandwiched layer 126, and the internal face support 204 abuts between 25% and 75% of the back surface of the intermediary sandwiched layer 126 such that 75% to 25% of the intermediary sandwiched layer 126 is unconstrained. In this embodiment, the vertical support portion 222 has vertical support length $L_V$ and a vertical support width $W_V$. The vertical support length $L_V$ is measured from the topline section of the perimeter support portion 206 to the sole section of the perimeter support portion 206. Preferably, the vertical support length $L_V$ is between about 15 mm and 30 mm and the vertical support width $W_V$ is between about 8 mm and 15 mm. Most preferably, the vertical support width $W_V$ is between about 30% and 70% of the vertical support length $L_V$. In this manner, the COR of the striking face portion 110 at face center FC can be controlled to be similar to the COR at ½ inch from face center FC towards the toe and ½ inch from face center FC towards the heel.

Figure 6:
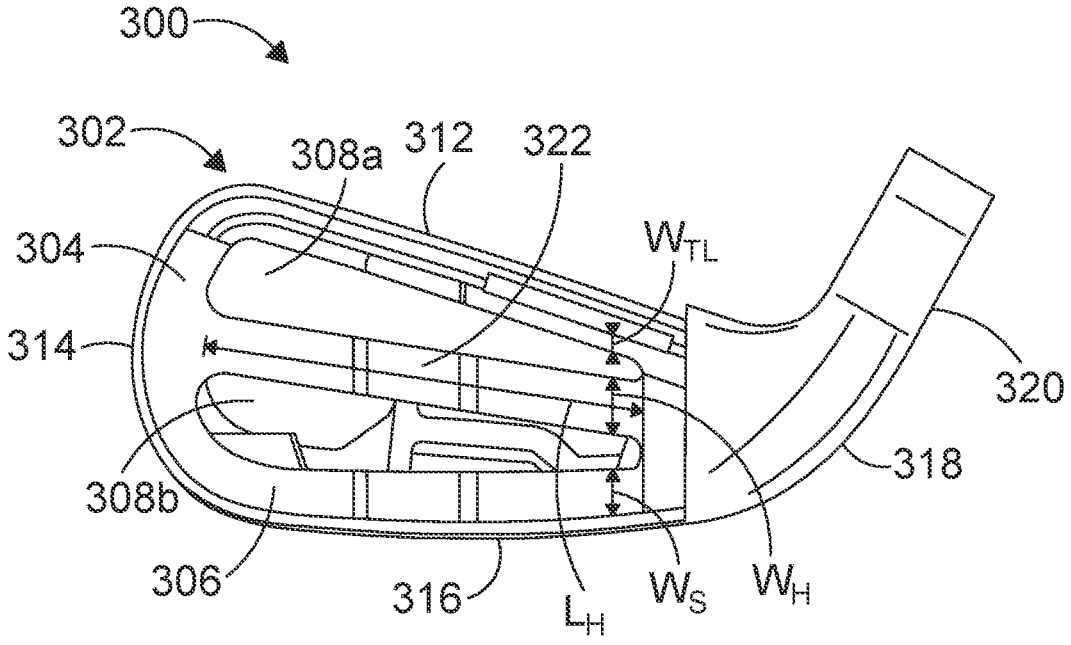
FIG. 6 of the accompanying drawings shows a frontal view of an alternate embodiment of the golf club head body in FIG. 1.

FIG. 6 discloses an alternate embodiment of the body disclosed in FIG. 1 and can be used with the striking face portion 110 and intermediary sandwiched layer 126 as discussed above and with reference to FIGS. 2 and 3, respectively. Golf club head 300 shown here has an aft body portion or body portion 302, including a topline portion 312, a toe portion 314, a sole portion 316, a heel portion 318 and hosel 320. The body portion 302 is further comprised of an internal face support 304 that includes a perimeter support portion 306 and a center portion 308. The perimeter support portion 306 is solid steel and preferably cast with the body portion 302 such that it is rigid with the body portion. The perimeter support portion 306 further surrounds the hollow center portion 308. This embodiment is further comprised of a horizontal support portion 322 that divides the hollow center portion 308 into a hollow top portion 308*a* and a hollow bottom portion 308*b*. In this embodiment, the horizontal support portion 322 is solid steel and is also preferably cast with the body portion 302.

As discussed above, the intermediary sandwiched layer 126 is supported by the internal face support 304 perimeter support portion 306 near the topline portion 312, the toe portion 314, the sole portion 316, and the heel portion 318. The intermediary sandwiched layer 126 is also supported by the horizontal support portion 322 of the internal face support 304 behind the face center FC. The perimeter support portion 306 preferably has a width of between about 2 mm and 20 mm. More preferably, the perimeter support portion has a first topline width $W_{TL}$ adjacent the topline portion 312 that is between about 2 mm and 5 mm and a second sole width $W_S$ that is adjacent the sole portion 316 that is between about 6 mm and 20 mm and is at least 1.5 times greater than the first topline width $W_{TL}$. Moreover, the internal face support 304 has hollow center portions 308*a* and 308*b* that don't support the intermediary sandwiched layer 126, and the internal face support 304 abuts between 25% and 75% of the back surface of the intermediary sandwiched layer 126 such that 75% to 25% of the intermediary sandwiched layer 126 is unconstrained. In this embodiment, the horizontal support portion 322 has horizontal support length $L_H$ and a horizontal support width $W_H$. The horizontal support length $L_H$ is measured from the heel portion of the perimeter support portion 306 to the toe portion of the perimeter support portion 306. Preferably, the horizontal support length $L_H$ is between about 40 mm and 80 mm and the horizontal support width $W_H$ is between about 5 mm and 10 mm. Most preferably, the horizontal support width $W_H$ is between about 5% and 25% of the horizontal support length $L_H$. In this manner, the COR of the striking face portion 110 at face center FC can be controlled across the striking face portion 110 and a solid feel can be achieved.

Figure 7:
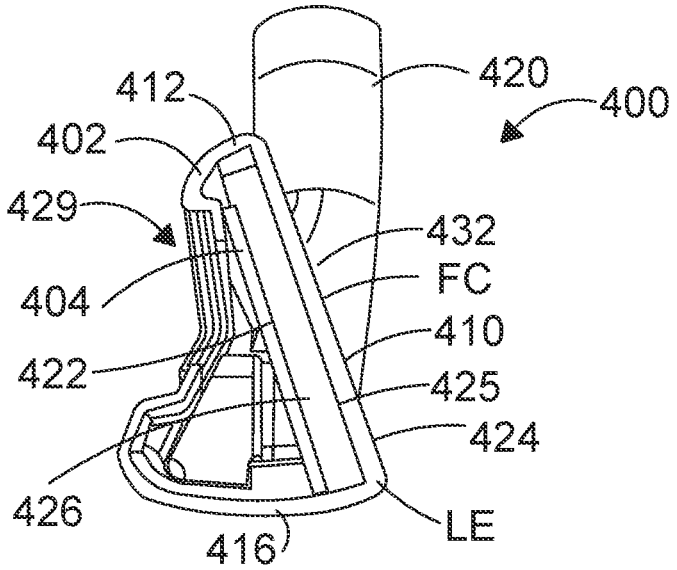
FIG. 7 of the accompanying drawings shows a cross-sectional view of an alternative embodiment of the golf club head in accordance with the present invention.
Figure 8:
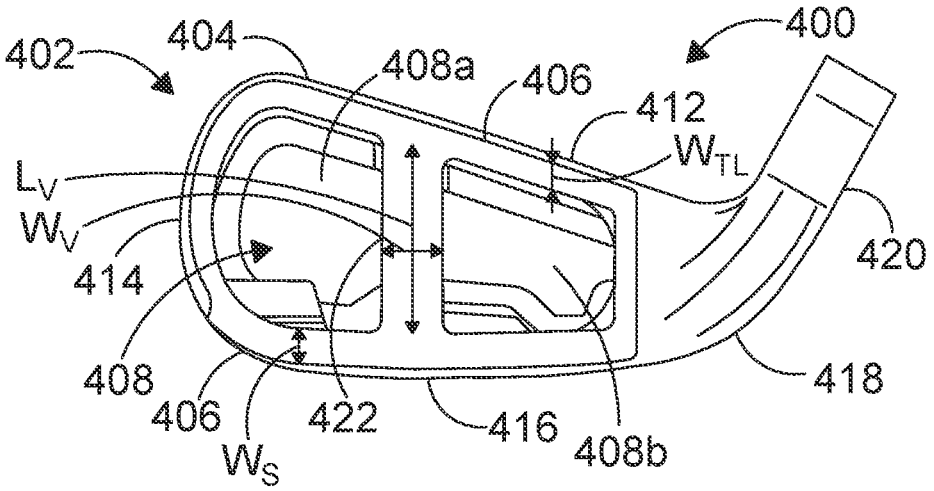
FIG. 8 of the accompanying drawings shows a frontal view of an alternate embodiment of the golf club head body in FIGS. 1 and 7.

FIGS. 7 and 8 of the accompanying drawings shows a golf club head 400 in accordance with an exemplary embodiment of the present invention. Golf club head 400 shown has an aft body portion or body portion 402, including a topline portion 412, a toe portion 414, a sole portion 416, a heel portion 418 and hosel 420. Golf club head 400 is further comprised of a striking face portion 410 which is coupled, preferably by welding to or by integrally casting with the body portion 402 to form a cavity therebetween. The golf club head 400 is further comprised of an internal face support 404 that includes a perimeter support portion 406 and a center portion 408. The perimeter support portion 406 is preferably a thermoplastic insert that is positioned within the body portion 402 such that it is rigid with the body portion 402. The perimeter support portion 406 further surrounds the hollow center portion 408. This embodiment is further comprised of a vertical support portion 422 that divides the hollow center portion 408 into a hollow toe side portion 408*a* and a hollow heel side portion 408*b*.

The striking face portion 410 shown in FIG. 7 includes a frontal face portion 424 having a face center FC. The frontal face portion 424 can be formed as a face cup such that it forms the leading-edge LE and has a toe portion, topline portion and a sole portion that couple to the body portion's toe portion 414, topline portion 412 and sole portion 416, respectively, preferably by welding. The external frontal face portion 424 is preferably formed of steel and located at an external frontal portion of the striking face portion 410. The external frontal face portion 424 has a substantially planar striking outer surface 432 that includes a plurality of grooves, not shown. More preferably, the external frontal face portion 424 is formed of a high strength steel having an Ultimate Tensile Strength of greater than 2000 MPa and more preferably greater than 2300 MPa. Most preferably, the external frontal face portion 424 is formed from AerMet 340 or the like. Moreover, it is preferred that the external frontal face portion 424 has a uniform thickness of about 0.6 mm to about 2.4 mm. Most preferably, the external frontal face portion 424 has a uniform thickness of about 1.4 mm to about 1.8 mm. This thin external frontal face portion 424 and its high strength assist in creating the high COR of the golf club head 400. Alternatively, the striking face portion 410 can be integrally cast with and be formed out of the same steel as the body portion 402.

An intermediary sandwiched layer such as 426 shown in FIG. 7 is sandwiched in the cavity between a back surface of the frontal face portion 424 and the internal face support 404. The intermediary sandwiched layer 426 has a frontal facing surface 425 that is substantially the same area as the back surface of the frontal face portion 424. Preferably, intermediary sandwiched layer 426 is supported by the internal face support 404 around its perimeter, i.e., the intermediary sandwiched layer 426 is supported by the internal face support perimeter support portion 406 near the topline portion 412, the toe portion 414, the sole portion 416, and the heel portion 418. However, the internal face support 404 has a hollow center portion 408 that doesn't support the intermediary sandwiched layer 426 like the perimeter support portion 406 does such that the intermediary sandwiched layer 426 is at least partially unconstrained.

The internal face support 404 is secured in an internal hollow portion 429 of the golf club head 400. The internal face support 404 is preferably formed from a thermoplastic material or thermoplastic composite having a tensile strength of about 60 MPa to 300 MPa and a flexural modulus of between about 2000 MPa and 8000 MPa. Preferably, the internal face support 404 has a thickness that is between about 0.5 mm and 5 mm, and more preferably, between about 0.8 mm and 2 mm.

As discussed above, the intermediary sandwiched layer 426 is a polymeric material having a tensile strength within the range of about 4 MPa and 20 MPa and more preferably, 6 MPa and 12 MPa, when measured according to ASTM D412. The very low tensile strength allows the external frontal face portion to deflect during impact and assists in creating a striking face portion with a very high COR. Still further, to keep the striking face portion from being too heavy, the specific gravity of the polymer is preferably between about 0.95 and 1.2 and the polymer has a Shore A hardness of less than 75, and preferably between about 30 and 60. Preferably, the intermediary sandwiched layer 426 is comprised of a silicone material, and more preferably, a silicone rubber such as SH9151U sold by KCC Silicone Corporation. Furthermore, the intermediary sandwiched layer 426 preferably has a substantially uniform thickness of about 1 mm to 10 mm, and more preferably, between about 3 mm and 7 mm. The intermediary sandwiched layer 426 is also preferably at least twice as thick as the external frontal face portion thickness at the face center FC.

As stated above, the perimeter support portion 406 preferably has a width of between about 2 mm and 20 mm. More preferably, the perimeter support portion has a first topline width $W_{TL}$ adjacent the topline portion 412 that is between about 2 mm and 5 mm and a second sole width $W_S$ that is adjacent the sole portion 416 that is between about 6 mm and 20 mm and is at least 1.5 times greater than the first width $W_{TL}$. Moreover, the internal face support 404 has a hollow center portion 408 that doesn't support the intermediary sandwiched layer 426 and abuts between 25% and 75% of the intermediary sandwiched layer back surface while the intermediary sandwiched layer 426 covers between 90% and 100% of the back surface of the external frontal face portion 424. Thus, the external frontal face portion 424 is substantially dampened by the intermediary sandwiched layer 426, but 75% to 25% of the intermediary sandwiched layer 426 is unconstrained by the internal face support 404. In this embodiment, the vertical support portion 422 has vertical support length $L_V$ and a vertical support width $W_V$. The vertical support length $L_V$ is measured from the topline section of the perimeter support portion 406 to the sole section of the perimeter support portion 406. Preferably, the vertical support length $L_V$ is between about 15 mm and 30 mm and the vertical support width $W_V$ is between about 8 mm and 15 mm. Most preferably, the vertical support width $W_V$ is between about 30% and 70% of the vertical support length $L_V$. In this manner, the COR of the striking face portion 410 at face center FC can be controlled to be similar to the COR at ½ inch from face center FC towards the toe and ½ inch from face center FC towards the heel.

Figure 9:
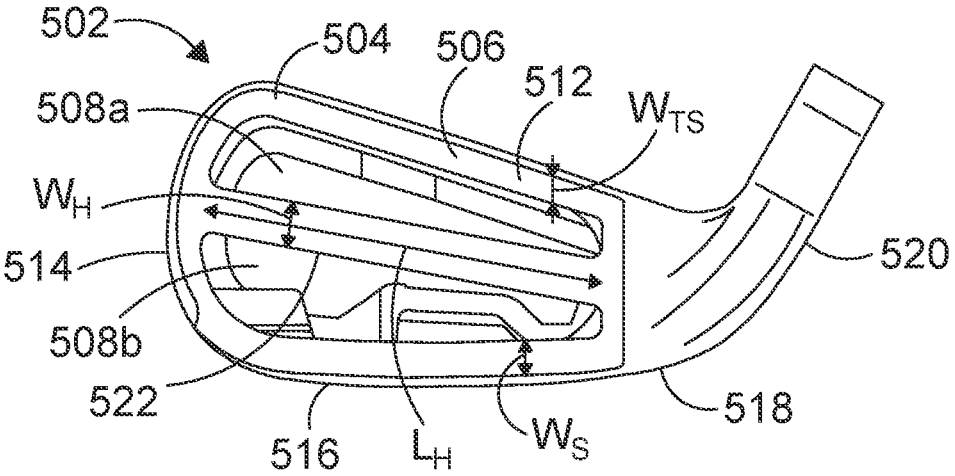
FIG. 9 of the accompanying drawings shows a frontal view of an alternate embodiment of the golf club head body in FIGS. 1 and 7.

FIG. 9 of the accompanying drawings shows a golf club head body portion 502 that can be combined with the striking face portion 110 disclosed in FIG. 2. In accordance with an exemplary embodiment of the present invention, aft body portion or body portion 502, including a topline portion 512, a toe portion 514, a sole portion 516, a heel portion 518 and hosel 520. The golf club head is further comprised of the striking face portion 110 which is coupled, preferably by welding to or by integrally casting with the body portion 502 to form a cavity therebetween. The golf club head is further comprised of an internal face support 504 that includes a perimeter support portion 506 and a center portion 508. The perimeter support portion 506 is preferably a thermoplastic insert that is positioned within the body portion 502 such that it is rigid with the body portion 502. The perimeter support portion 506 further surrounds the hollow center portion 508. This embodiment is further comprised of a horizontal support portion 522 that divides the hollow center portion 508 into a hollow toe side portion **508*a* and a hollow heel side portion 508*b***.

Again, the striking face portion 110 shown in FIG. 2 includes a frontal face portion 124 having a face center FC. The frontal face portion 124 can be formed as a face cup such that it forms the leading-edge LE and has a toe portion, topline portion and a sole portion that couple to the body portion's toe portion 514, topline portion 512 and sole portion 516, respectively, preferably by welding. The external frontal face portion 124 is preferably formed of steel and located at an external frontal portion of the striking face portion 110. The external frontal face portion 124 has a substantially planar striking outer surface 132 that includes a plurality of grooves, not shown. More preferably, the external frontal face portion 124 is formed of a high strength steel having an Ultimate Tensile Strength of greater than 2000 MPa and more preferably greater than 2300 MPa. Most preferably, the external frontal face portion 124 is formed from AerMet 340 or the like. Moreover, it is preferred that the external frontal face portion 124 has a uniform thickness of about 0.6 mm to about 2.4 mm. Most preferably, the external frontal face portion 124 has a uniform thickness of about 1.4 mm to about 1.8 mm. This thin external frontal face portion 124 and its high strength assist in creating the high COR of the golf club head. Alternatively, the striking face portion 110 can be integrally cast with and be formed out of the same steel as the body portion 102.

An intermediary sandwiched layer such as 126 shown in FIG. 3 is sandwiched in the cavity between a back surface of the frontal face portion 124 and the internal face support 504. The intermediary sandwiched layer 126 has a frontal facing surface 127 that is substantially the same area as the back surface of the frontal face portion 124. Preferably, intermediary sandwiched layer 126 is supported by the internal face support 504 around its perimeter, i.e., the intermediary sandwiched layer 126 is supported by the internal face support perimeter support portion 506 near the topline portion 512, the toe portion 514, the sole portion 516, and the heel portion 518. However, the internal face support 504 has a hollow center portion 508 that doesn't support the intermediary sandwiched layer 126 like the perimeter support portion 506 does such that the intermediary sandwiched layer 126 is at least partially unconstrained.

The internal face support 504 is secured in an internal hollow portion of the golf club head. The internal face support 504 is preferably formed from a thermoplastic material or thermoplastic composite having a tensile strength of about 60 MPa to 300 MPa and a flexural modulus of between about 2000 MPa and 8000 MPa. Preferably, the internal face support 504 has a thickness that is between about 0.5 mm and 5 mm, and more preferably, between about 0.8 mm and 2 mm.

As discussed above, the intermediary sandwiched layer 126 is a polymeric material having a tensile strength within the range of about 4 MPa and 20 MPa and more preferably, 6 MPa and 12 MPa, when measured according to ASTM D412. The very low tensile strength allows the external frontal face portion to deflect during impact and assists in creating a striking face portion with a very high COR. Still further, to keep the striking face portion from being too heavy, the specific gravity of the polymer is preferably between about 0.95 and 1.2 and the polymer has a Shore A hardness of less than 75, and preferably between about 30 and 60. Preferably, the intermediary sandwiched layer 126 is comprised of a silicone material, and more preferably, a silicone rubber such as SH9151U sold by KCC Silicone Corporation. Furthermore, the intermediary sandwiched layer 126 preferably has a substantially uniform thickness of about 1 mm to 10 mm, and more preferably, between about 3 mm and 7 mm. The intermediary sandwiched layer 126 is also preferably at least twice as thick as the external frontal face portion thickness at the face center FC.

As stated above, the perimeter support portion 506 preferably has a width of between about 2 mm and 20 mm. More preferably, the perimeter support portion has a first topline width $W_{TL}$ adjacent the topline portion 512 that is between about 2 mm and 5 mm and a second sole width $W_S$ that is adjacent the sole portion 516 that is between about 6 mm and 20 mm and is at least 1.5 times greater than the first width $W_{TL}$. Moreover, the internal face support 504 has a hollow center portion 508 that doesn't support the intermediary sandwiched layer 126 and abuts between 25% and 75% of the intermediary sandwiched layer back surface while the intermediary sandwiched layer 126 covers between 90% and 100% of the back surface of the external frontal face portion 124. Thus, the external frontal face portion 124 is substantially dampened by the intermediary sandwiched layer 126, but 75% to 25% of the intermediary sandwiched layer 126 is unconstrained by the internal face support 504. In this embodiment, the horizontal support portion 522 has horizontal support length $L_H$ and a horizontal support width $W_H$. The horizontal support length $L_H$ is measured from the heel portion of the perimeter support portion 506 to the toe portion of the perimeter support portion 506. Preferably, the horizontal support length $L_H$ is between about 40 mm and 80 mm and the horizontal support width $W_H$ is between about 5 mm and 10 mm. Most preferably, the horizontal support width $W_H$ is between about 5% and 25% of the horizontal support length $L_H$. In this manner, the COR of the striking face portion 110 at face center FC can be controlled across the striking face portion 110 and a solid feel can be achieved.

Figure 10:
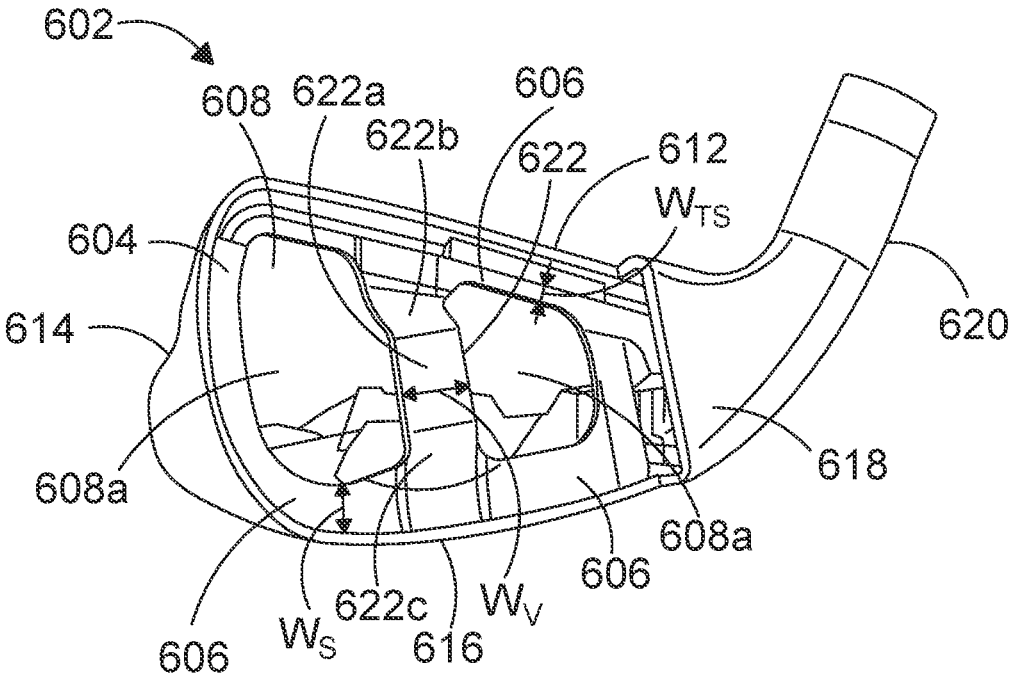
FIG. 10 of the accompanying drawings shows a frontal view the golf club head body portion in accordance with an alternate embodiment of the present invention in FIG. 6.
Figure 11:
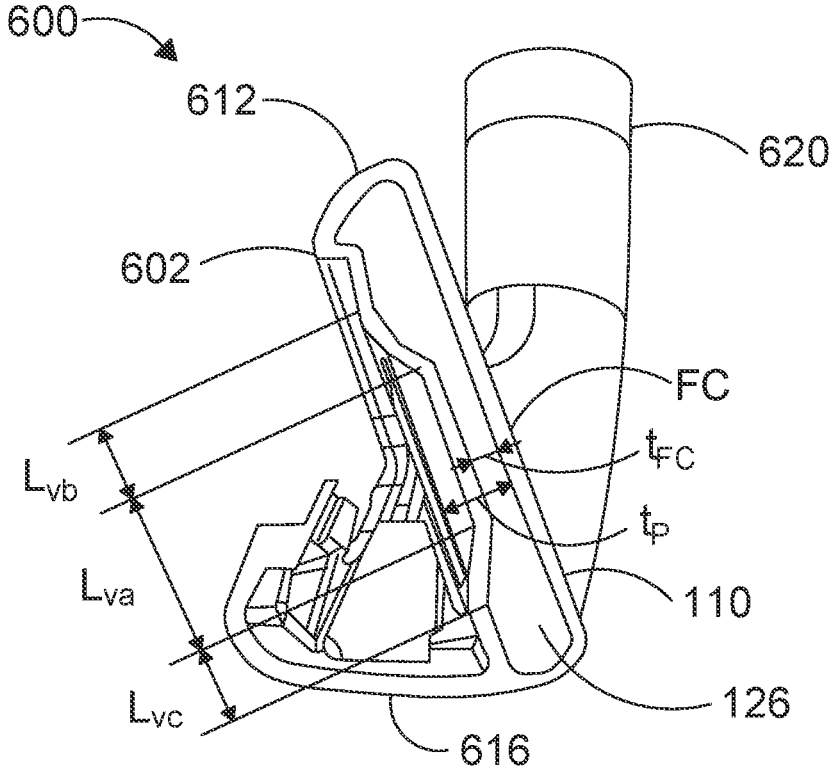
FIG. 11 of the accompanying drawings shows a cross-sectional view of a portion of the golf club head in the embodiment in FIG. 10.

FIGS. 10 and 11 discloses an alternate embodiment of the golf club head body disclosed in FIG. 5 and can be interchanged for the body portion 202 and used with the striking face portion 110 and intermediary sandwiched layer 126 as discussed above and with reference to FIGS. 2 and 3, respectively, as discussed above. Golf club head 600 shown here has an aft body portion or body portion 602, including a topline portion 612, a toe portion 614, a sole portion 616, a heel portion 618 and hosel 620. The body portion 602 is further comprised of an internal face support 604 that includes a perimeter support portion 606 and a center portion 608. The perimeter support portion 606 is solid steel and preferably cast with the body portion 602 such that it is rigid with the body portion 602. The perimeter support portion 606 further surrounds the hollow center portion 608. This embodiment is further comprised of a vertical support portion 622 that divides the hollow center portion 608 into a hollow toe side portion 608*a* and a hollow heel side portion 608*b*. In this embodiment, the vertical support portion 622 is solid steel and is also preferably cast with the body portion 602.

As discussed above, the intermediary sandwiched layer 126 is supported by the internal face support 604 perimeter support portion 606 near the topline portion 612, the toe portion 614, the sole portion 616, and the heel portion 618. The intermediary sandwiched layer 126 is also supported by the vertical support portion 622 of the internal face support 604 behind the face center FC. The perimeter support portion 606 preferably has a width of between about 2 mm and 20 mm. More preferably, the perimeter support portion has a first topline width $W_{TL}$ adjacent the topline portion 612 that is between about 2 mm and 5 mm and a second sole width $W_S$ that is adjacent the sole portion 616 that is between about 6 mm and 20 mm and is at least 1.5 times greater than the first topline width $W_{TL}$. Moreover, the internal face support 604 has hollow center portions 608*a* and 608*b* that don't support the intermediary sandwiched layer 126, and the internal face support 604 abuts between 25% and 75% of the back surface of the intermediary sandwiched layer 126 such that 75% to 25% of the intermediary sandwiched layer 126 is unconstrained. In this embodiment, the vertical support portion 622 has vertical support length $L_{VA}$, $L_{VB}$, and $L_{VC}$ and a vertical support width $W_V$. The vertical support length $L_{VA}$, $L_{VB}$, and $L_{VC}$ is measured from the topline section of the perimeter support portion 606 to the sole section of the perimeter support portion 606. Preferably, the vertical support length $L_{VA}$, $L_{VB}$, and $L_{VC}$ is between about 15 mm and 30 mm and the vertical support width $W_V$ is between about 8 mm and 15 mm. Most preferably, the vertical support width $W_V$ is between about 30% and 70% of the vertical support length $L_{VA}$, $L_{VB}$, and $L_{VC}$. In this manner, the COR of the striking face portion 110 at face center FC can be controlled to be similar to the COR at ½ inch from face center FC towards the toe and ½ inch from face center FC towards the heel. In this embodiment, the vertical support portion 622 is further divided into three portions, the center vertical support portion 622*a*, the top vertical support portion 622*b* and the bottom vertical support portion 622*c*. Preferably, the center vertical support portion 622*a* is substantially closer to the striking face portion 110 such that the intermediary sandwiched layer 126 has a first thickness at the face center $t_{FC}$ that is less than second perimeter thickness surrounding the face center $t_P$. As shown, the top vertical support portion 622*b* and the bottom vertical support portion 622*c* couple the center vertical portion 622 to the perimeter support portion 606 but are angled from the perimeter support portion 606 toward the striking face portion 110. In this manner, the first thickness at the face center $t_{FC}$ is between about 80% and 40% of the second perimeter thickness $t_P$ ½ inch from face center toward the toe portion 614 and heel portion 618. Preferably, the center vertical support portion 622*a* has a center vertical support length $L_{VA}$, the top vertical support portion 622*b* has a top vertical support length $L_{VB}$ and the bottom vertical support portion 622*c* has a bottom vertical support length $L_{VC}$. In the preferred embodiment, the center vertical support length $L_{VA}$ is at least 20% greater than both the top vertical support length $L_{VB}$ and the bottom vertical support length $L_{VC}$. In this manner, the COR of the striking face portion 110 can be held more constant in the areas around the face center FC.

Figure 12:
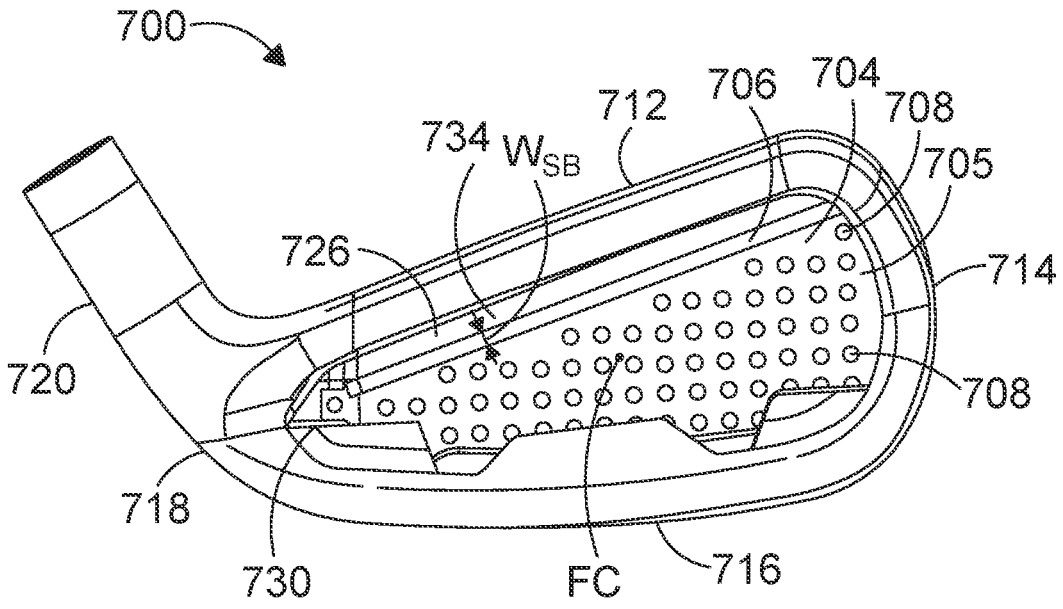
FIG. 12 of the accompanying drawings shows a back view of a golf club head in accordance with an embodiment of the present invention.
Figure 13:
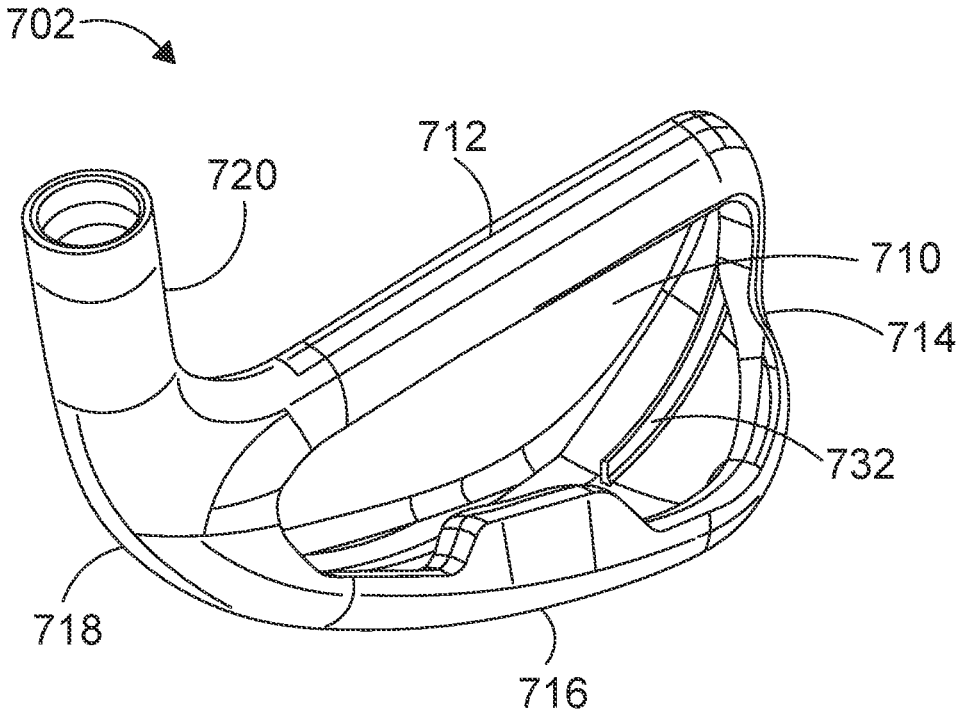
FIG. 13 of the accompanying drawings shows a perspective view of the aft body portion of the golf club head in FIG. 12.

FIGS. 12 and 13 of the accompanying drawings shows a golf club head 700 and golf club head body portion 702, respectively. In accordance with an exemplary embodiment of the present invention, aft body portion or body portion 702, including a topline portion 712, a toe portion 714, a sole portion 716, a heel portion 718 and hosel 720 can be integrally cast with the striking face portion 710. The golf club head is further comprised of an internal face support 704 that includes a support bar portion 706, a center support portion 705 and a plurality of apertures 708. The internal face support 704 is preferably a thermoplastic insert, having a support layer tensile strength of between 60 MPa and 300 MP and a flexural modulus of between about 2000 MPa and 8000 MPa, that is positioned within the body portion 702 such that it is rigid with the body portion 702. The internal face support 704 is preferably coupled to the body portion 702 by abutting or snap fitting onto a plurality of lip portions 732 inside the body portion 702 and by a fastener 730 located near the heel portion 718. The support bar portion 706 is spaced from the topline portion 712 for easy insertion into the body portion 702, and therefore, creates a gap 734 between the topline portion 712 and the support bar portion 706. Preferably, the center support portion 705 has a thickness that is between about 0.5 mm and 5 mm, and more preferably, between about 0.8 mm and 2 mm. For structural stability, the support bar portion 706 has a width $W_{SB}$ that is between about 2 mm and 5 mm and a thickness that is at least 1.5 times the thickness of the center support portion 705.

An intermediary sandwiched layer such as 726 shown in FIG. 12 is sandwiched in the cavity between a back surface of the striking face portion 710 and the internal face support 704. The intermediary sandwiched layer 726 has a frontal facing surface that is substantially the same area as the back surface of the striking face portion 710. Preferably, the internal face support 704 has a plurality of apertures 708 and the gap 734 that do not support the intermediary sandwiched layer 726. Thus, the internal face support 704 only abuts between 25% and 75% of the intermediary sandwiched layer back surface while the intermediary sandwiched layer 726 covers between 90% and 100% of the back surface of the striking face portion 710.

As discussed above, the intermediary sandwiched layer 726 is a polymeric material having a tensile strength within the range of about 4 MPa and 20 MPa and more preferably, 6 MPa and 12 MPa, when measured according to ASTM D412. The very low tensile strength allows the external frontal face portion to deflect during impact and assists in creating a striking face portion with a very high COR. Still further, to keep the golf club head 700 from being too heavy, the specific gravity of the polymer is preferably between about 0.95 and 1.2 and the polymer has a Shore A hardness of less than 75, and preferably between about 30 and 60. Preferably, the intermediary sandwiched layer 726 is comprised of a silicone material, and more preferably, a silicone rubber such as SH9151U sold by KCC Silicone Corporation. Furthermore, the intermediary sandwiched layer 726 preferably has a substantially uniform thickness of about 1 mm to 10 mm, and more preferably, between about 3 mm and 7 mm. The intermediary sandwiched layer 726 is also preferably at least twice as thick as the striking face portion 710 thickness at the face center FC.

Figure 14:
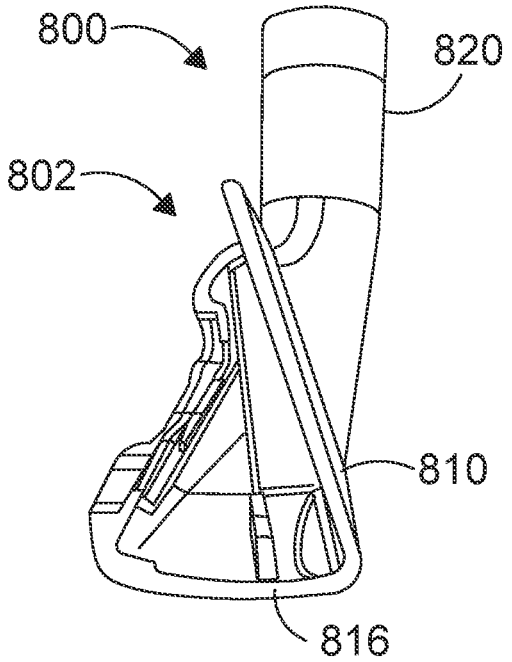
FIG. 14 of the accompanying drawings shows a cross-sectional view of an aft body portion of a golf club head in accordance with an embodiment of the present invention.
Figure 15:
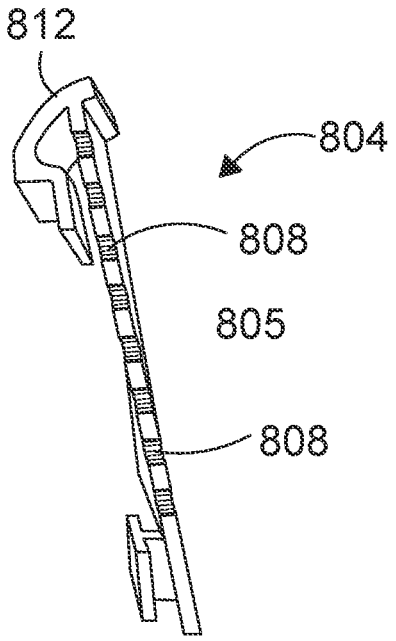
FIG. 15 of the accompanying drawings shows a cross-sectional view of an internal support layer of the golf club head in FIG. 14.
Figure 16:
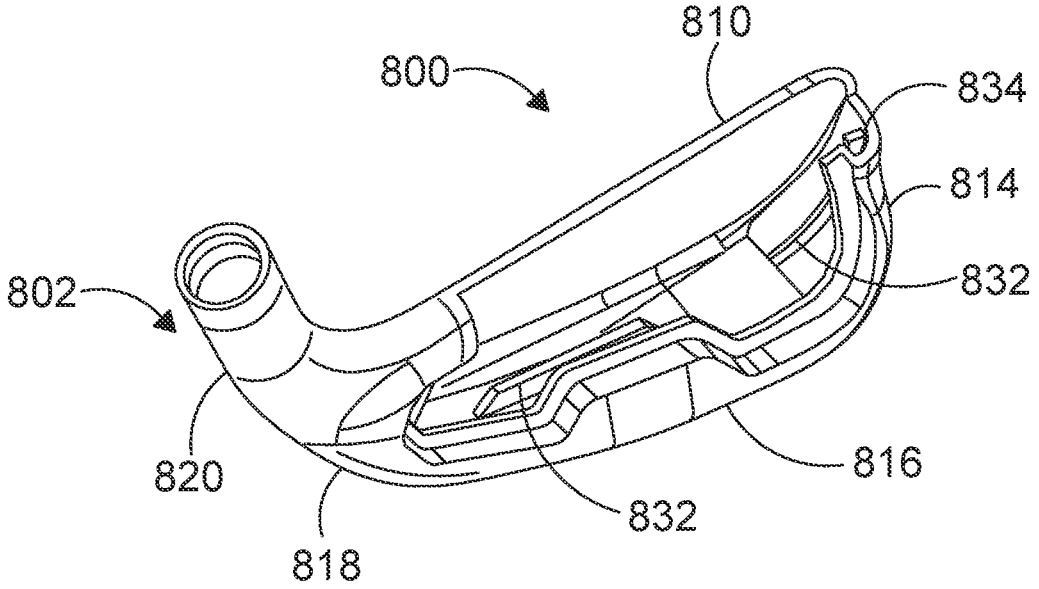
FIG. 16 of the accompanying drawings shows a rear, perspective view of the body portion of the golf club head in FIGS. 14-15.

FIGS. 14-16 of the accompanying drawings show portions of a golf club head 800. In accordance with an exemplary embodiment of the present invention, aft body portion or body portion 802, includes a toe portion 814, a sole portion 816, a heel portion 818 and hosel 820 that can be integrally cast with the striking face portion 810. The golf club head is further comprised of an internal face support 804 that includes a topline portion 812, a center support portion 805 and a plurality of apertures 808. Like above, the internal face support 804 is preferably a thermoplastic insert, having a support layer tensile strength of between 60 MPa and 300 MP and a flexural modulus of between about 2000 MPa and 8000 MPa, that is positioned within the body portion 802 such that it is rigid with the body portion 802. The internal face support 804 is preferably coupled to the body portion 802 by abutting or snap fitting onto a plurality of lip portions 832 inside the body portion 802 and ledge portions 834 at the toe portion 814 and heel portion 818. Fasteners can also be incorporated if necessary. Preferably, the center support portion 805 has a thickness that is between about 0.5 mm and 5 mm, and more preferably, between about 0.8 mm and 2 mm.

An intermediary sandwiched layer such as 726 shown in FIG. 12 is sandwiched in the cavity between a back surface of the striking face portion 810 and the internal face support 804. Preferably, the internal face support 804 has a plurality of apertures 808 that do not support the intermediary sandwiched layer 726. The internal face support 804 preferably only abuts between 25% and 75% of the intermediary sandwiched layer back surface while the intermediary sandwiched layer 726 covers between 90% and 100% of the back surface of the striking face portion 810.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. An iron type golf club comprising:

a golf club head, a grip and a shaft therebetween, wherein the golf club head comprises:

a striking face portion located at a frontal portion of the golf club head and an aft body portion attached to the striking face portion forming a cavity therebetween and forming a topline portion, a sole portion, a toe portion, a heel portion and a hosel, the striking face portion having a striking face portion face center, a striking face portion back surface, and a thickness of between 0.6 mm and 2.4 mm at the face center;

an internal support layer located in the cavity and coupled to the aft body portion, the internal support layer having an internal support layer front surface; and an intermediary sandwiched layer juxtaposed between the striking face portion and the internal support layer and being comprised of a polymeric material having a sandwiched face layer hardness of less than 75 Shore A, the intermediary sandwiched layer having a thickness of 1 mm and 10 mm at the face center, and the intermediary sandwiched layer having an intermediary sandwiched layer front surface and a intermediary sandwiched layer back surface, and;

wherein the internal support layer front surface abuts between 25% and 75% of the intermediary sandwiched layer back surface.

2. The golf club of claim 1, wherein the intermediary sandwiched layer front surface abuts between 90% and 100% of the striking face portion back surface.

3. The golf club of claim 1, wherein the internal support layer comprises a perimeter support portion circumscribing the cavity and having a width of between 2 mm and 20 mm and a thickness of between 0.5 mm and 5 mm.

4. The golf club of claim 3, wherein the internal support layer further comprises a horizontal support section extending from a heel section of the perimeter support portion to a toe section of the perimeter support portion.

5. The golf club of claim 3, wherein the internal support layer further comprises a vertical support section extending from a topline section of the perimeter support portion to a sole section of the perimeter support portion.

6. The golf club of claim 3, wherein the internal support layer is comprised of steel and is integrally cast with the aft body portion.

7. The golf club of claim 3, wherein the internal support layer is comprised of a thermoplastic material having an internal support layer tensile strength that is at least 10 times greater than an intermediary sandwiched layer tensile strength.

8. The golf club of claim 1, wherein the striking face portion has a thickness of between 1.4 mm and 1.8 mm at the face center.

9. The golf club of claim 1, wherein the intermediary sandwiched layer has a thickness of 4 mm and 7 mm at the face center.

10. The golf club of claim 3, wherein the perimeter support portion has a topline width WTL adjacent the topline portion that is between 2 mm and 5 mm and a sole width WS adjacent the sole portion that is between 6 mm and 20 mm.

11. The golf club of claim 10, wherein the sole width WS is at least 1.5 times greater than the topline width WTL.

12. The golf club of claim 4, wherein the horizontal support section has a horizontal support width WH between 5 mm and 10 mm.

13. The golf club of claim 5, wherein the vertical support section has a vertical support width WV between 8 mm and 15 mm.

14. The golf club of claim 13, wherein the vertical support section has a center portion that is closer to the striking face portion such that the intermediary sandwiched layer has a face center thickness that is between 80% and 40% of an intermediary sandwiched layer thickness closer to the toe portion.

15. The golf club of claim 13, wherein the vertical support section has a center portion that is closer to the striking face portion such that the intermediary sandwiched layer has a first thickness at face center that is between 80% and 40% of an intermediary sandwiched layer thickness closer to the heel portion.

16. An iron type golf club comprising:

a golf club head, a grip and a shaft therebetween, wherein the head comprises:

a striking face portion located at a frontal portion of the golf club head and an aft body portion attached to the striking face portion forming a cavity therebetween, a topline portion, a sole portion, a toe portion, a heel portion and a hosel, the striking face portion having a face center and a thickness of between 0.8 mm and 2.4 mm at the face center;

an internal support layer coupled to the aft body portion such that it is located in the cavity and has a forward-facing front surface; and an intermediary sandwiched layer juxtaposed between the striking face portion and the internal support layer, the intermediary sandwiched layer having a thickness of 1 mm and 10 mm at the face center, the intermediary sandwiched layer having an intermediary sandwiched layer back surface and front surface, said intermediary sandwiched layer being comprised of a polymeric material having a sandwiched face layer tensile strength of between 4 MPa and 20 MPa;

wherein the internal support layer comprises a thermoplastic material having a support layer tensile strength of between 60 MPa and 300 MPa and wherein the internal support layer comprises a perimeter support portion circumscribing the cavity and having a perimeter width of between 2 mm and 20 mm and a thickness of between 0.5 mm and 5 mm.

17. The golf club of claim 16, wherein the striking face portion has a back surface and the intermediary sandwiched layer front surface abuts between 90% and 100% of the striking face portion back surface.

18. The golf club of claim 16, wherein the internal support layer further comprises a horizontal support section extending from a heel section of the perimeter support portion to a toe section of the perimeter support portion.

19. The golf club of claim 18, wherein the horizontal support section has a horizontal support width that is at least 10% greater than the perimeter width.

20. The golf club of claim 16, wherein the internal support layer further comprises a vertical support section extending from a topline section of the perimeter support portion to a sole section of the perimeter support portion.

21. The golf club of claim 16, wherein the support layer tensile strength is at least 10 times greater than the sandwiched face layer tensile strength.

* * * * *